US008794960B2

(12) United States Patent
Lifshits et al.

(10) Patent No.: US 8,794,960 B2
(45) Date of Patent: Aug. 5, 2014

(54) LOW $NO_x$ BURNER

(75) Inventors: Vladimir Lifshits, Redwood City, CA (US); Stephen B. Londerville, Half Moon Bay, CA (US)

(73) Assignee: John Zink Company, LLC, Foster City, CA (US)

( * ) Notice: Subject to any disclaimer, the term of this patent is extended or adjusted under 35 U.S.C. 154(b) by 1470 days.

(21) Appl. No.: 12/150,885

(22) Filed: Apr. 30, 2008

(65) Prior Publication Data

US 2008/0206693 A1 Aug. 28, 2008

Related U.S. Application Data

(63) Continuation-in-part of application No. 11/067,312, filed on Feb. 25, 2005, now Pat. No. 7,422,427.

(60) Provisional application No. 60/547,924, filed on Feb. 25, 2004.

(51) Int. Cl.
*F23Q 9/00* (2006.01)

(52) U.S. Cl.
USPC ..... 431/284; 431/285; 431/116; 110/262

(58) Field of Classification Search
USPC ..... 431/9, 116, 278, 284, 285
See application file for complete search history.

(56) References Cited

U.S. PATENT DOCUMENTS 4,162,140 A * 7/1979 Reed ..... 431/284
4,277,942 A * 7/1981 Egnell et al. ..... 60/517
4,303,386 A * 12/1981 Voorheis et al. ..... 431/177
4,643,672 A * 2/1987 Lefebvre ..... 431/265
4,646,637 A * 3/1987 Cloots ..... 110/245
5,044,932 A * 9/1991 Martin et al. ..... 431/116
5,098,282 A * 3/1992 Schwartz et al. ..... 431/9
5,135,387 A * 8/1992 Martin et al. ..... 431/116
5,195,884 A * 3/1993 Schwartz et al. ..... 431/8
5,275,554 A * 1/1994 Faulkner ..... 431/115
5,299,930 A * 4/1994 Weidman ..... 431/10
5,388,536 A * 2/1995 Chung ..... 110/264
5,460,512 A 10/1995 Lifshits (Continued)

OTHER PUBLICATIONS

Barendregt, et al., "Applying ultra-low-$No_x$ burners," *Petrochemical and Gas Processing* , PTQ Q2 2006, 6 pages (2006).

*Primary Examiner* — Steven B McAllister
*Assistant Examiner* — Desmond C Peyton
(74) *Attorney, Agent, or Firm* — Kilpatrick Townsend & Stockton LLP

(57) ABSTRACT

A low NOx burner for installation on a furnace wall has an elongated tube connected to a combustion air supply, the furnace side end of which mounts a combustion air spinner that is spaced from the furnace wall. A plurality of air ports extend through the wall into the combustion chamber. Downstream ends of the air ports are spaced from the furnace wall as well as from the spinner, and they are configured to bias the discharged air flow towards the spinner. A plurality of first fuel gas spuds with fuel gas discharge orifices arranged about the spinner and discharges fuel gas into the combustion chamber downstream of the spinner. A second fuel gas spud is disposed in pockets between adjacent pairs of air ports which are closed against the furnace wall so that no combustion air flows through the pockets. The third gas spuds are placed inside the air ports.

17 Claims, 3 Drawing Sheets

(56) References Cited

U.S. PATENT DOCUMENTS

| | | | | |
|---|---|---|---|---|
| 5,494,437 | A * | 2/1996 | Kubota et al. | 431/181 |
| 5,542,840 | A * | 8/1996 | Surbey et al. | 431/116 |
| 6,565,361 | B2 * | 5/2003 | Jones et al. | 438/6 |
| 6,685,462 | B2 * | 2/2004 | Jones et al. | 431/8 |
| 6,695,609 | B1 * | 2/2004 | Chung et al. | 431/9 |
| 7,244,119 | B2 * | 7/2007 | Chung et al. | 431/116 |
| 2001/0034001 | A1 * | 10/2001 | Poe et al. | 431/116 |
| 2004/0248054 | A1 * | 12/2004 | Poe et al. | 431/116 |
| 2005/0175945 | A1 * | 8/2005 | Chung et al. | 431/116 |
| 2005/0239005 | A1 * | 10/2005 | Lugnet et al. | 431/8 |
| 2005/0271990 | A1 | 12/2005 | Lifshits | |
| 2008/0280238 | A1 * | 11/2008 | Smith et al. | 431/9 |
| 2008/0293002 | A1 * | 11/2008 | Lifshits | 431/116 |

* cited by examiner

LOW $NO_x$ BURNER

CROSS-REFERENCES TO RELATED APPLICATIONS

This application is a continuation in part of U.S. patent application Ser. No. 11/067,312 filed Feb. 25, 2005 for an "Energy Efficient Low $NO_x$ Burner and Method of Operating Same", the disclosure of which is incorporated herein by reference.

BACKGROUND OF THE INVENTION

The present invention relates to low $NO_x$ emitting burners which are compact, efficient to operate, and employ furnace gas recirculation inside the combustion chamber of the furnace to reduce $NO_x$ emissions.

Furnace emissions are of great concern because they significantly contribute to atmospheric pollution. A large source for $NO_x$ emissions is burners as used in large and small furnaces, including, for example, very large furnaces used for generating electric power with steam-operated turbines. It is well known that $NO_x$ emissions are reduced by lowering the temperature of the flame generated by the burner inside the furnace. Conventionally this has been attained by supplying the burner with excess air over what would be required to stoichiometrically fire the fuel, because the fuel must heat the additional air, which lowers the overall temperature of the flame and the furnace gases generated thereby.

Another approach to lowering $NO_x$ emissions is to mix the combustion air for the burner with flue gas going to the exhaust stack. This technique is called flue gas recirculation (FGR). Flue gas typically has a temperature in the range of between about 200° F. to 400° F. Recirculated flue gas lowers flame temperatures and $NO_x$ generation, but in excessive amounts causes flame instability and blowout.

Both of these approaches can be used individually or in combination. However, large amounts of FGR that might be necessary for reducing $NO_x$ substantially increase the overall volume of gas that must be transported through the burner and the furnace convection section. This in turn requires larger blowers and conduits, including the common windbox outside the front wall of a burner, to handle the increased combined mass of air and FGR with an elevated temperature that must be transported through the system. This increases initial installation costs as well as subsequent operation and maintenance costs due to the increased energy requirements of the blower, all of which is undesirable.

As disclosed in the above-referenced, copending application, high amounts of FGR that must be recirculated can be reduced by recirculating furnace gases internally of the combustion chamber. This has worked well in reducing $NO_x$ emissions and has the advantage that it reduces or eliminates additional energy to operate a larger blower to handle additional combustion air and/or recirculated flue gas. The main part of the burner disclosed in the copending application is a massive cylindrical tube which extends from the furnace wall. The spinner is mounted at the discharge end of this tube. The portion of the tube proximate the furnace wall includes openings through which furnace gases are aerodynamically driven by air and fuel gas jets inside the tube where the furnace gases are mixed with combustion air and fuel prior to the ignition of the mixture. However, this burner is susceptible to overheating and damage to the tube if fuel starts burning inside the confines of the tube. Conditions for the fuel burning inside the tube may happen when the overall incoming mixture of air, flue gas and fuel gas is insufficiently diluted with inert gases like FGR. Steering the operating regimes of the burner away from the flame burning inside also requires shifting more toward the discharge end of the tube that is usually not optimal for achieving the lowest $NO_x$ emissions.

BRIEF SUMMARY OF THE INVENTION

The present invention further improves on the low $NO_x$ burner described in the above-referenced copending patent application in that it eliminates the need for a tube enclosing the burner and simplifies the construction and operation of the burner as described below.

A low $NO_x$ burner constructed in accordance with the present invention is installed in a furnace that has a furnace wall which encloses the combustion chamber of the furnace. The burner is installed on a wall of the furnace and extends through an opening therein into the combustion chamber, where it generates a flame.

The burner itself has a combustion air spinner that is wholly disposed in the combustion chamber, and its downstream end is spaced a substantial distance from the furnace wall, as is further described below. A combustion air tube extends into the combustion chamber, supports the spinner, and flows combustion air from a combustion air source outside the furnace through the spinner into the combustion chamber.

A plurality of air ports, preferably six, but more or less can be used, extends from the furnace wall into the combustion chamber. They are circumferentially equally spaced from each other to define spaces between them and typically supply a major portion of the required combustion air alone or, when needed, mixed with FGR. Their discharge ends are disposed inside the combustion chamber, upstream of the spinner, and they are spaced apart from the spinner and the furnace wall.

Suitable plates between adjacent air ports block combustion air from flowing from the combustion air source into the furnace except through the ports and the pipe at the center of the burner.

A first set of elongated fuel spuds, preferably a number of fuel spuds which corresponds to the number of air ports, extends from the fuel source past the furnace wall into the combustion chamber. Their fuel gas discharge orifices at the ends of the spuds are spaced from the furnace wall at least as far as the downstream end of the spinner so that fuel gas is discharged into the combustion chamber, where the fuel gas becomes mixed with combustion air from the spinner.

At least one second fuel spud is located in each pocket space between adjacent air ports, and extends from the fuel source past the furnace wall into the combustion chamber. Each second fuel gas spud is radially spaced from the axis of the burner so that it is located proximate a radially outermost portion of the adjacent ports. Each second fuel spud has a downstream end that includes one or more fuel discharge orifices disposed inside the combustion chamber and inside the pockets, downstream of the furnace wall and upstream of the discharge ends of the air ports.

The aerodynamic forces created by the second fuel jets and the air flow discharging through the air ports cause a circulation of combustion products (hereafter also referred to as "furnace gas") from the flame in the combustion chamber back to the furnace front wall. During this circulation the combustion products partially cool down due to the heat transfer to the furnace water tube walls. As a result, fuel gas propagating from second spuds through the space between the air ports mixes first with essentially inert reduced temperature furnace gas. This non-combustible mixture is further mixed with combustion air from the discharge ends of the air ports upstream of the spinner for the subsequent ignition of the mixture by the flame in the combustion chamber on the downstream side of the spinner.

The burner is further preferably associated with a fuel gas valve or regulator that is operatively coupled with the fuel gas source and is set to direct relatively more fuel gas through the second fuel gas spuds than the first fuel gas spuds.

In accordance with a presently preferred embodiment of the invention, the burner includes a third set of fuel gas spuds with nozzles that are disposed inside the respective air ports. The third fuel gas nozzles are placed along the air ports centerlines—typically multiple nozzles in each air port arranged, for example, along the radial centerline of the air port. The size and location of the nozzles are chosen to create an approximately uniform distribution of fuel with the air stream. All third nozzles inject the fuel in the same direction as the surrounding air streams.

The earlier-mentioned pockets between adjacent air ports are circumferentially open inside the combustion chamber, and neither the air tube nor the spinner are enclosed inside a tube or conduit so that they are in the furnace gas recirculation. This means that furnace gases recirculating inside the combustion chamber can enter the pockets between adjacent air ports, where they mix with fuel gas to form a non-combustible fuel gas/furnace gas mixture that flows in a downstream direction towards the spinner. Downstream of the air port, this mixture is further mixed with combustion air from the air ports and forms a fuel gas/combustion air/furnace gas mixture that can be ignited by the existing flame downstream of the spinner.

For specific applications it may be desired, or necessary, to deliver to the windbox a mixture of combustion air and FGR. This alternative is preferably limited to applications where particularly low $NO_x$ emissions, below what can be accomplished with furnace gas recirculation alone, must be attained because it requires larger and therefore more costly blowers, ducts, windboxes, etc.

In operation following the initial lighting of the burner, the flame generated by the burner is anchored on the downstream end of the spinner, relatively remote from the front furnace wall on which the burner is mounted. Since the burner is not enclosed inside a tube or tubular member and the main air discharge ports are located relatively close to the furnace front wall, while the spinner is relatively remote from the wall and far inside the combustion chamber, the flow velocities of the fuel gas, combustion air and their mixture have decreased significantly by the time they reach the spinner. This avoids the problem encountered with typical prior art burners which are located inside and proximate the ends of surrounding tubular conduits where higher fuel gas-combustion air mixture velocities can lead to flame instabilities and relatively early flameouts when trying to achieve lowest $NO_x$ emissions. With the burner of the present invention, the discharged air and gases are not constrained to limited cross-sections and, therefore, they decelerate relatively quickly, which aids in stabilizing the flame at the spinner. Thus, the present invention lowers the flow velocity of gases surrounding the spinner, increases flame stability and significantly lowers the likelihood of flameouts, while lower $NO_x$ emissions are achieved with a burner that is less costly to build, install, maintain and operate than comparable prior art burners.

In addition, by placing all fuel gas spuds inside the radially outermost extent of the air ports and eliminating a burner throat traditionally formed by the furnace wall, the radial footprint of the burner (relative to the furnace wall) is reduced so that it occupies less space on the burner front wall and inside the furnace chamber. This feature is particularly advantageous for retrofitting existing furnaces with low $NO_x$ burners where size of the opening available for the burner is limited by the front wall water tubes (because presently available low $NO_x$ burners are typically significantly larger than conventional burners due to their need for higher FGR rates and additional features needed to lower the $NO_x$).

DETAILED DESCRIPTION OF THE INVENTION

Figure 1:
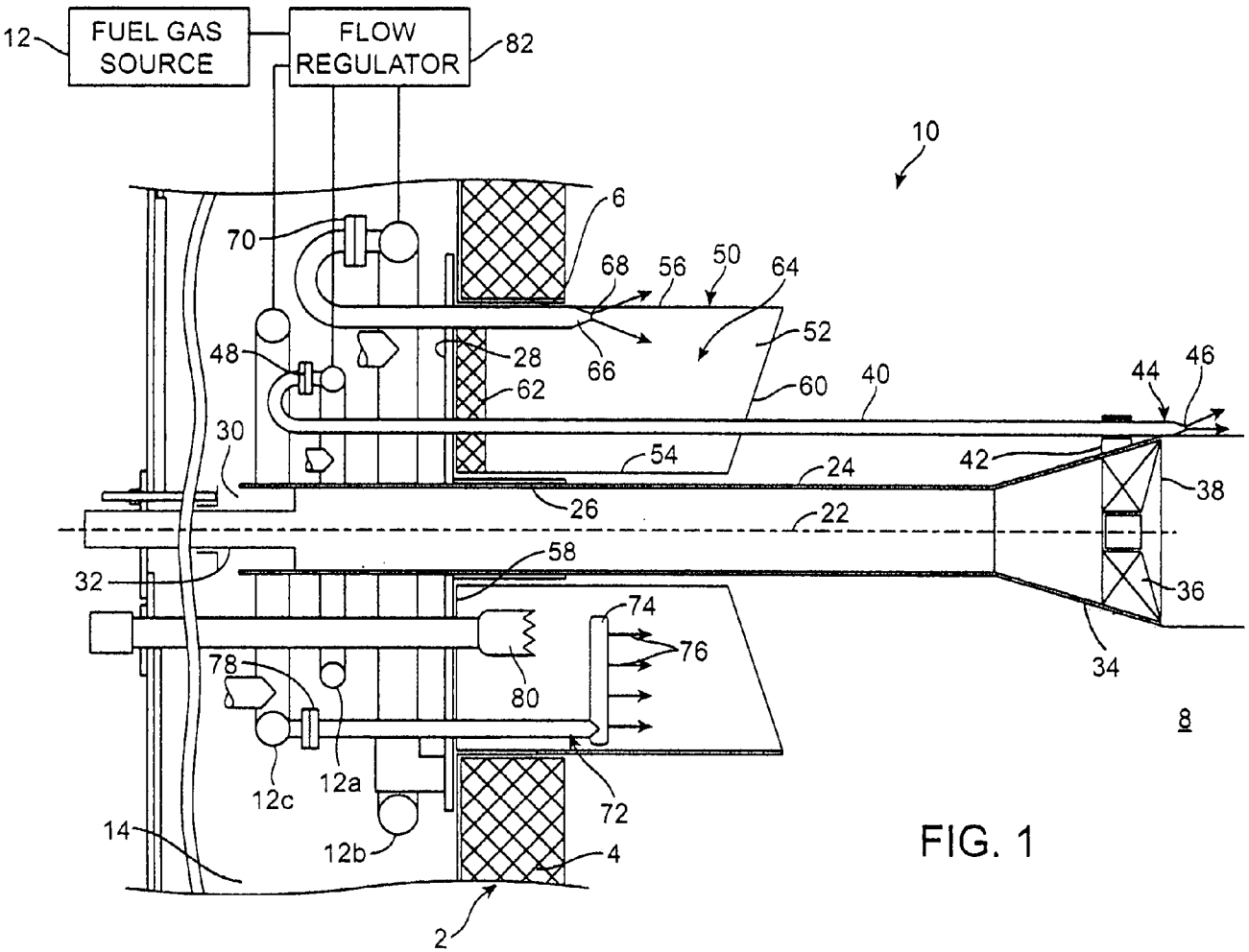
FIG. 1 is a schematic, side elevational cross-section view of a low $NO_x$ burner made in accordance with the present invention, installed on a furnace wall and taken on line I-I of FIG. 2.

Referring to the drawings, a furnace 2 has a front wall 4 with an opening 6 that provides access into a combustion chamber 8 inside the furnace. A low $NO_x$ burner 10 constructed in accordance with the present invention extends through opening 6 into the combustion chamber of furnace 2, where it forms a flame 84 for generating heat. For example, the furnace may be a boiler that generates steam.

A fuel gas supply 12 and a combustion air supply 90 are suitably coupled to windbox 14 attached to furnace front wall 4. The burner directs the fuel and the combustion air into the combustion chamber, where they are mixed, ignited and combusted, thereby releasing heat energy and generating high temperature furnace gases which are typically discharged into a convection section 16 of the furnace where temperature is reduced, typically to a range between about 200-400° F. The cooled flue gas is discharged to the atmosphere through a stack 20. As will be explained in more detail later, a portion of the cooled flue gas is at times recirculated into the combustion chamber via a flue gas recirculating system 18.

Figure 2:
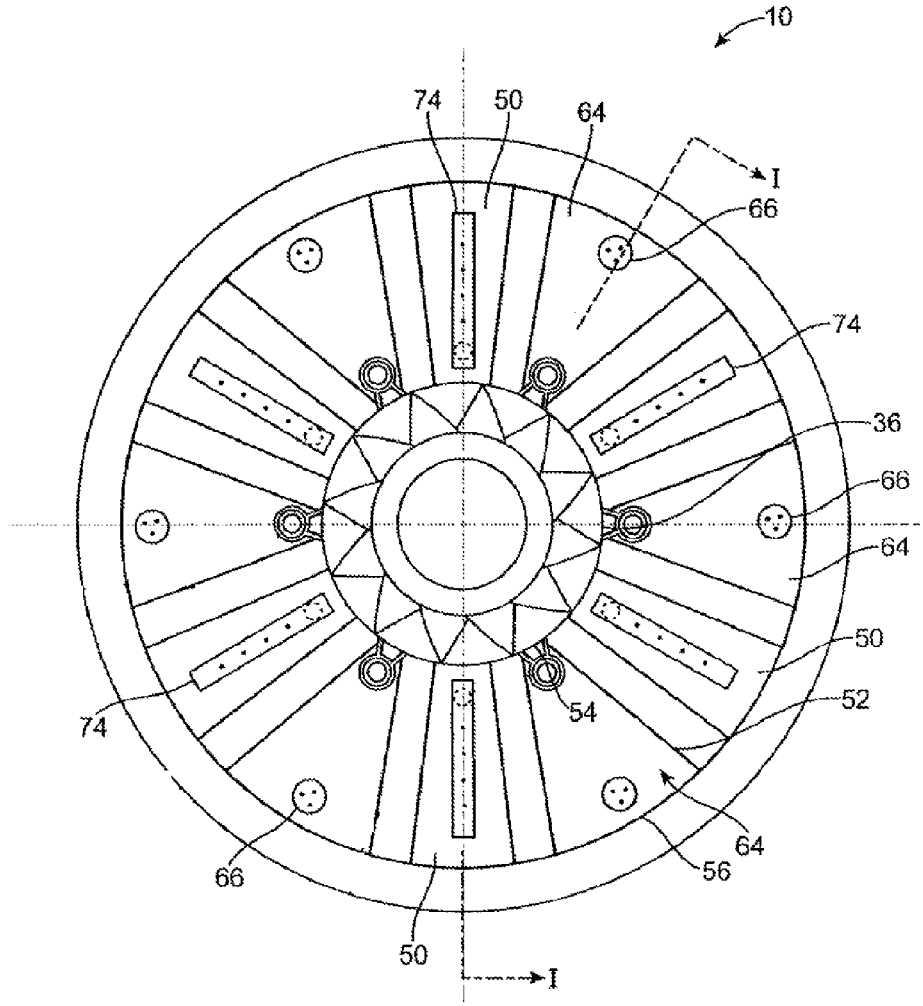
FIG. 2 is a front elevational view of the burner shown in FIG. 1.

Referring now specifically to FIGS. 1 and 2, burner 10 has an elongated burner axis 22 which also is the axis of a combustion air tube 24 that is supported by a suitable tube mount 26 on a plate 28. An aft or upstream end 30 of the tube is open, extends into windbox 14, and has a damper 32 which can be used to adjust the flow of combustion air into the tube, as is well known to those of ordinary skill in the art.

At its downstream end 34, the burner tube supports a combustion air spinner 36 which has a downstream end with the spinner blades 38. The combustion air tube is sufficiently long so that the downstream end of the spinner is located at a substantial distance from furnace front wall 4. In one embodiment of the invention, the burner tube has a diameter of about 6.5 inches and the downstream end of the spinner is spaced from the furnace wall approximately 44 inches, so that the downstream end of the spinner is spaced from the furnace wall by slightly less than six times the diameter of the tube. For most applications, the distance between the furnace front wall and the downstream end of the spinner will be in the range between about four to eight times the diameter of the combustion air tube 24, although for particular installations and purposes and furnace configurations this range can be greater or less.

In the illustrated embodiment, a plurality of six center fuel gas spuds 40 are circumferentially equally spaced about the periphery of spinner 36, they are held in place on the spinner by suitable spud holders 42, and their downstream ends 44 are spaced from furnace wall 4 at least as far as downstream end 38 of the spinner and, preferably, they extend slightly beyond the spinner, as is illustrated in FIG. 1. The downstream ends of the center spuds have orifices 46 from which fuel gas is discharged into the swirling air flow passing through the spinner. An upstream end 48 of each center spud is fluidly coupled to fuel gas source 12, shown in FIG. 1 as a circular fuel gas supply tube or manifold 12*a*.

In the illustrated embodiment, a plurality of six combustion air ports 50 formed by elongated conduits are circumferentially equally spaced about combustion air tube 24, as is best seen in FIG. 2. Each air port is formed by radially inner and outer walls 54, 56 and side walls 52. The cross-section of the air ports is tapered in a downstream direction by side walls 52 so that an upstream end 58 of the air port has a larger cross-section than a downstream discharge end 60 thereof. The discharge end in turn is tapered (as best seen in FIG. 1) so that the outermost wall 56 of the air port extends further into combustion chamber 8 than the innermost wall 54 thereof. This taper induces a bias into combustion air flowing through the air ports which directs the air flow towards spinner 36 for ignition by the flame on the downstream side of the spinner.

For typical burner constructions in accordance with the present invention, the spacing between furnace front wall 4 and the discharge end 60 of air ports 50 is in the range between about one-fourth to one-half the distance between the furnace wall and downstream end 38 of spinner 36. In a particularly preferred embodiment of the invention, the air port discharge end is spaced 16 inches from the furnace wall, while the downstream end of the spinner is spaced 44 inches. However, these ranges can be exceeded upwardly or downwardly should this be desirable for a given installation.

Between each adjacent pair of air ports is a radially outwardly open space that is closed in an upstream direction by burner plate 28 and heat insulation 62. The spaces between adjacent air ports form pockets 64 which are closed in an aft direction and also substantially in a radially inward direction and which are open in the downstream and radially outward directions, as can be seen in FIG. 1. As a result, effectively no combustion air from windbox 14 flows into or through the pockets.

Center spuds 40 extend through burner plate 28 into and past pockets 64 to the spinner in the combustion chamber. An additional set of second fuel gas spuds 66 is arranged close to a radially outermost portion of pockets 4 which is proximate outer walls 56 of air ports 50. The downstream ends of the second spuds have orifices 68. Downstream ends of second spuds 66 with orifices 68 are located in the combustion chamber just downstream of furnace wall 4 and upstream of discharge ends 60 of air ports 50 in pockets 64. Upstream ends 70 of spuds 66 are fluidly connected to fuel source 12 in the form of a second circular fuel gas manifold 12*b*. Fuel gas exiting through orifices 68 flows into pockets 64.

A third set of fuel spuds 72 is preferably arranged inside each air port 50 and includes an elongated nozzle tube 74 that extends transversely to the flow direction, preferably along the centerline of the air port, through the air port and has fuel gas discharge orifices 76. An upstream end 78 of the third set of spuds 72 is fluidly connected to fuel gas supply 12 in the form of a third, circular fuel gas manifold 12*c*. Each spud 72 typically has multiple discharge orifices 78 that are placed along the centerlines of the air port. The size and location of the nozzles is chosen to create an approximately uniform distribution of fuel in the air stream. Orifices 76 have centerlines that face in the direction of axis 22 as is shown on FIG. 1.

In use, combustion air flows from windbox 14 through air ports 50 past discharge ends 60 thereof in a downstream direction as earlier described. Gas discharge nozzle tubes 74 in the air ports present detrimental resistance to the combustion air flow that is proportional to the second power of the air velocity around nozzle tubes 74. To minimize this resistance, tubes 74 are placed inside the ports 64 at a location where the cross-section of the air ports (in the plane perpendicular to axis 22) is substantially greater than the cross-section of the air port at discharge end 60 so that the air flow velocity past the nozzle tubes 74 is substantially less than its velocity at the discharge end.

A pilot 80 shown on FIG. 1 is appropriately located inside at least one of the air ports 50 and activated for initially igniting a first portion of a combustion air-fuel gas mixture formed downstream of the fuel gas nozzle tube 74. The flame originated by the pilot further extends past the spinner discharge end 38, where it ignites the rest of the fuel delivered to the burner.

A fuel gas flow regulator 82 receives fuel gas from source 12, directs controlled quantities of the fuel gas to fuel gas manifolds 12*a-c* and controls the amount of fuel gas delivered to each of the manifolds. For typical, normal operations of the furnace gas, the fuel gas regulator delivers between about 5 to 20% of total fuel gas requirements to center spuds 40, between about 30 to 70% of total gas requirements to outer spuds 66, and between about 10 to 40% of the fuel gas requirements to the fuel gas spuds 72 inside air ports 50.

For start-up of the furnace, burner 10 is activated by initially blowing air from windbox 14 into and through combustion chamber 8 of the furnace to purge the combustion chamber of any fuel residues that may be present. For lighting the burner, a reduced combustion air flow through air tube 24 and air ports 50 into the combustion chamber is initiated. Pilot light 80 in at least one air port 50 is lit to generate a flame that extends forward towards spinner 36, and fuel gas flow regulator 82 is opened to flow fuel gas past the orifices at the downstream ends of inner spuds 40, outer spuds 66 and spuds 72 inside air ports 50. Thus, the pilot flame and the ignited fuel gas extend past downstream end 38 of spinner 36, which causes the ignition of the fuel gas emitted by all fuel gas spuds of the burner.

Once a flame downstream of spinner 36 is lit, pilot 80 is turned off. The flame extending from inside the air ports 50 to the spinner becomes extinguished due to a lack of flame stability inside the air ports without the presence of a sufficiently strong pilot flame. The operation of the burner continues with a flame 84 formed inside combustion chamber 8 and downstream of spinner 36, fed by fuel from the spuds of the burner and combustion air discharged into the combustion chamber via spinner 36 and air ports 50.

Figure 3:
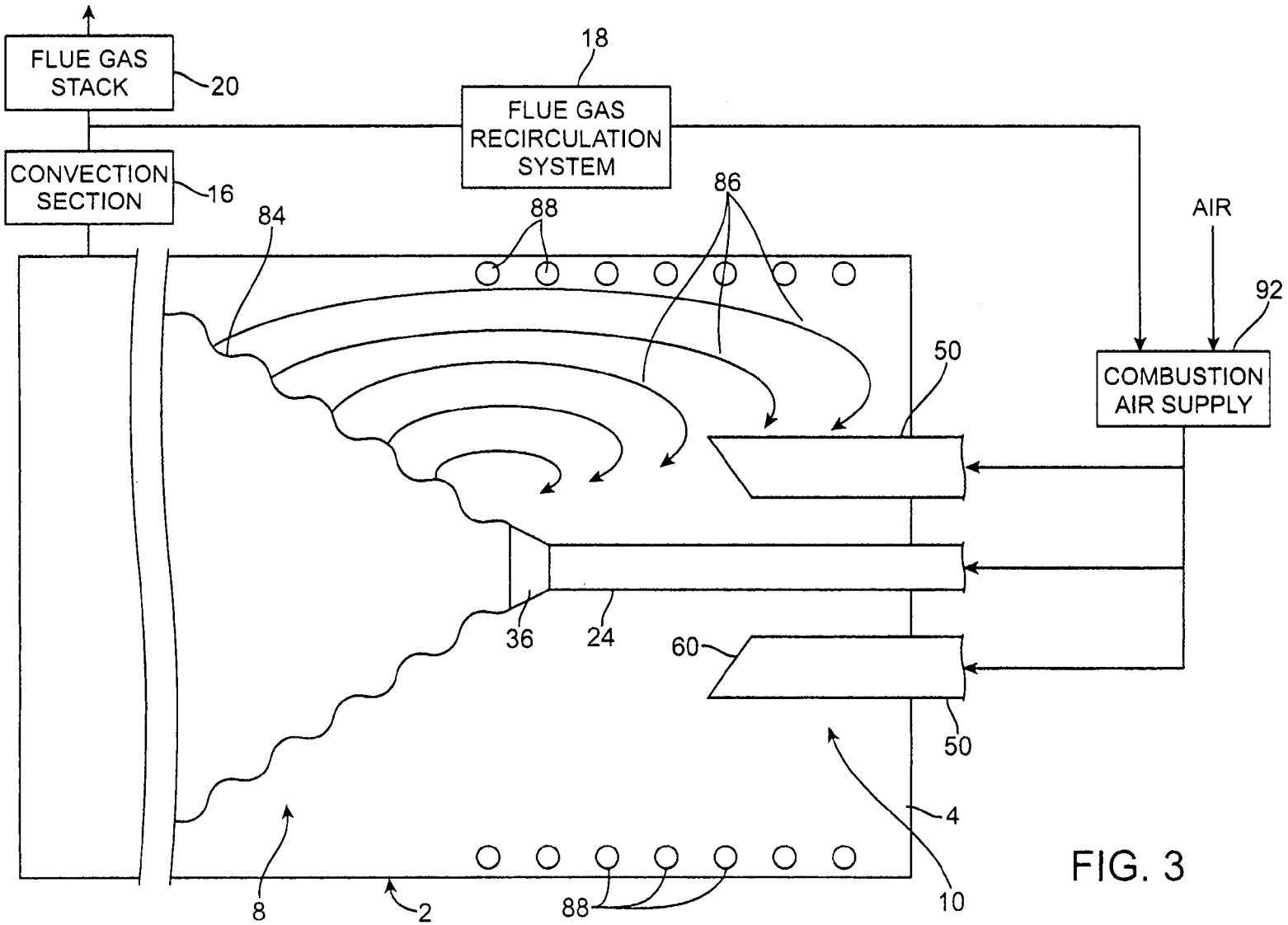
FIG. 3 is a schematic diagram illustrating the recirculation of furnace gases inside the combustion chamber of the furnace in accordance with the present invention.

The momentum of air and fuel jets coming out from discharge ends of ports 50 and the momentum of fuel gas jets from orifices 68 in pockets 64 cause a recirculation 86 of furnace gases from inner portions of the combustion chamber (downstream of spinner 36) towards front wall 4 of the furnace, as is illustrated in FIG. 3. The recirculating furnace gases are typically partially cooled from the initial flame temperature by heat transfer to furnace walls covered with tubes 88 normally arranged inside the furnace, e.g. along the walls thereof. Some of the recirculating flue gas enters pockets 64 between adjacent pairs of air ports 50 where fuel gas from outer spuds 66 is entrained in the furnace gas. Downstream of air port discharge ends 60, this fuel gas/furnace gas mixture mixes with combustion air from air ports 50, which typically includes fuel gas from nozzle tubes 74 of the third set of spuds 72. The furnace gas/combustion air/fuel mixture flows towards spinner 36 as previously described, and downstream of spinner 36 the mixture is ignited by flame 84 stabilized by the action of the spinner 38.

The entrainment of recirculating furnace gas into the fuel gas/combustion air mixture results in a reduced temperature of flame 84, which in turn reduces the generation and emission of $NO_x$. This is advantageously attained without an increase in the flow into and through the furnace convection section 16 and without a need for larger blower 92 and conduit sizes that would be required if the flame temperature would be reduced, for example, by increasing the flow of flue gas recirculation 18.

In addition, by the time the recirculating furnace gas reaches back to the boiler front, it typically has a temperature of about 1000 to 2000° F. When this gas mixes with flows coming from air ports 60, it raises the overall temperature of the resulting mixture prior to its ignition to about 600 to 800° F. This substantially increases the ratio between the gas temperatures prior to and after the ignition (for a very low $NO_x$ flame, its temperature is about 2500° F.). As a result, the combustion process is more easily initiated and maintained. This stabilizes the flame and constitutes a significant benefit attained with the present invention.

If $NO_x$ emissions need to be reduced to below what is feasible by recirculating furnace gas inside the combustion chamber, some of the flue gas is added to the combustion air via a flue gas recirculation system 18. The recirculated flue gas lowers the available oxygen supply in the fuel gas/combustion air/recirculated furnace gas mixture, which leads to a further reduction of flame temperatures and therewith the $NO_x$ content of the furnace gas before it is discharged to the environment via flue gas treatment 16 and stack 20.

The described device allows to achieve lower minimum $NO_x$ emissions with a stable flame than other known devices that would occupy the same overall space on the furnace front wall, and it is overall more energy efficient for delivering comparable levels of the $NO_x$ emissions.

What is claimed is:

1. A low $NO_x$ burner for use with a furnace having a wall and a combustion chamber, the burner comprising:

an elongated tube for connection to a combustion air supply, attached to the wall and extending a first distance from the wall into the combustion chamber, a combustion air spinner defining an axis of the burner and connected to the elongated tube at the first distance so that upon installation of the elongated tube on the wall a downstream end of the spinner is inside the combustion chamber and remote from the furnace wall, a plurality of elongated air ports arranged around the elongated tube and connected to the combustion air supply and extending from the wall into the combustion chamber, downstream discharge ends of the air ports being spaced from the furnace wall a second distance, the second distance being less than the first distance, a plurality of first fuel gas spuds having fuel gas discharge orifices in a vicinity of a downstream end of the spinner, a plurality of second fuel gas spuds, each disposed between each adjacent pair of air ports, adapted to be connected to a fuel gas source, arranged relative to the axis proximate radially outermost portions of the air ports and having fuel discharge orifices downstream of the furnace wall and upstream of the discharge ends of the air ports, such that the second fuel gas spuds are not located in a combustion air flow, and wherein each air port forms an elongated conduit, and a third fuel gas spud arranged in each conduit, and wherein the third fuel gas spud is positioned inside the conduit at a location upstream of the discharged end of the conduit.

2. A low $NO_x$ burner according to claim 1 including at least six air ports circumferentially equally spaced about the tube.

3. A low $NO_x$ burner according to claim 2 including a number of first fuel gas spuds circumferentially equally spaced about a periphery of the spinner equal to the number of air ports.

4. A low $NO_x$ burner according to claim 1 wherein the elongated conduit having a cross-section that is largest at an upstream end of the conduit and smallest at a downstream end thereof so that, upon flowing combustion air through the conduit, the combustion air velocity is greatest at the discharge end of the conduit.

5. A low $NO_x$ burner according to claim 4 including where the velocity of the combustion air past the third fuel gas spuds is lower than the velocity of the combustion air at the discharge end of the conduit.

6. A low $NO_x$ burner according to claim 4 wherein the discharge end of the conduit is shaped so that a radially outermost portion of the conduit extends further into the combustion chamber than a radially innermost portion of the conduit for biasing the flow of combustion air discharged from the air port towards the spinner.

7. A low $NO_x$ burner according to claim 1 wherein the discharge ends of the air ports extend between 25% to 75% of the distance between the furnace wall and a downstream end of the spinner.

8. A low $NO_x$ burner according to claim 1 including an igniter placed through one of the air ports for igniting the burner during start-up operations of the furnace.

9. A low $NO_x$ burner adapted to be installed on a furnace having a wall and a combustion chamber comprising a combustion air tube having a spinner mounted on the combustion air tube and having a downstream end located inside the combustion chamber at a first distance from the furnace wall, at least six elongated, spaced-apart air ports substantially equally arranged about the tube for flowing combustion air into the combustion chamber, each air port having a downstream discharge end that is spaced a second distance from the furnace wall which is less than the first distance, a wall member arranged in spaces between adjacent pairs of air ports proximate upstream ends thereof for preventing combustion air from flowing between adjacent air ports, a first plurality of fuel gas discharge spuds arranged about a periphery of the spinner and having discharge orifices extending at least as far as the first distance into the combustion chamber, a second plurality of fuel gas discharge spuds, each arranged in the space between adjacent pairs of air ports, the second plurality of fuel gas spuds being positioned proximate radially outermost portions of the air ports and having a fuel gas discharge orifice for flowing fuel gas into the combustion chamber which is spaced from the furnace wall a third distance which is less than the second distance, and wherein each air port forms an elongated conduit, and a third fuel gas spud arranged in each conduit, and wherein the third fuel gas spud is positioned inside the conduit at a location upstream of the discharged end of the conduit.

10. A low $NO_x$ emitting furnace comprising a furnace wall enclosing a combustion chamber, a low $NO_x$ burner with a longitudinal axis installed on the wall and extending through an opening in the wall into the combustion chamber, the burner generating a flame in the combustion chamber that generates products of combustion in the chamber which are discharged as flue gases following a treatment of the furnace gases, a source of combustion air and a source of fuel gas for generating the flame, the burner including a spinner wholly disposed in the combustion chamber so that a downstream end of the spinner is spaced a first distance from the furnace wall, a combustion air conduit for flowing combustion air from the source through the spinner into the combustion chamber, a plurality of air ports extending from the furnace wall into the combustion chamber and circumferentially equally spaced from each other to define spaces between the air ports, the air ports having discharge ends disposed inside the combustion chamber which are upstream of the spinner and spaced apart from the furnace wall a second distance, the second distance being less than the first distance, plates between adjacent pairs of air ports which prevent combustion air from flowing from the combustion air source through the spaces between the air ports, a first set of elongated fuel spuds extending from the fuel source past the furnace wall opening into the combustion chamber and having fuel gas discharge orifices which are spaced from the furnace wall at least as far as the downstream end of the spinner for discharging fuel gas into the combustion chamber and mixing the fuel gas with combustion air from the spinner, at least one second fuel spud in each space between adjacent air ports extending from the fuel source past the furnace wall into the combustion chamber, each second fuel gas spud being radially spaced from the axis so that the second spud is located proximate a radially outermost portion of the adjacent air ports, each second fuel spud having a downstream end including a fuel gas discharge orifice which is disposed inside the combustion chamber, downstream of the furnace wall and upstream of the discharge ends of the adjacent air ports so that fuel gas discharged by the second spuds mixes with furnace gas recirculating in the combustion chamber towards the furnace wall and into the spaces between adjacent air ports for forming a non-combustible fuel gas-furnace gas mixture upstream of the downstream ends of the air ports, the non-combustible mixture being additionally mixed with combustion air from the discharge ends of the air ports upstream of the spinner for subsequent ignition by the flame in the combustion chamber substantially downstream of the spinner, a fuel gas discharge regulator operatively coupled with the fuel gas source and the fuel gas spuds for directing relatively more fuel gas through the second fuel gas spuds than through the first fuel gas spuds, and a third fuel spud disposed inside each air port and having a fuel gas discharge orifice located upstream of the discharge end for injecting fuel gas in combustion air flowing through the air port.

11. A furnace installation according to claim 10 wherein the spaces, the first fuel gas spuds, the spinner and the combustion air conduit are unobstructed in a radial direction relative to the axis so that recirculating fuel gas in the combustion chamber can freely flow into the spaces and into a vicinity of the first fuel gas spuds, the spinner and the combustion air conduit for facilitating mixing the fuel gas, the combustion air and the recirculating furnace gas upstream of the downstream end of the spinner.

12. A furnace installation according to claim 11 including a third fuel gas spud disposed inside each air port and having a fuel gas discharge orifice located upstream of the discharge end of the air port for entraining fuel gas in the combustion air flowing through the air port and there forming a mixture of fuel gas and combustion air.

13. A furnace installation according to claim 12 wherein the regulator directs relatively less fuel gas to the third fuel gas spuds than to the second fuel gas spuds.

14. A furnace installation according to claim 10 wherein the discharge ends of the air ports are slanted so that a radially outermost part of each air port extends further into the combustion chamber than a radially innermost end of the air port to thereby bias combustion air from the air ports towards the spinner.

15. A furnace installation according to claim 10 including a conduit for entraining a preselected amount of flue gas into the combustion air.

16. A furnace installation according to claim 10 wherein the furnace includes a multiplicity of heat exchange pipes disposed inside the combustion chamber, and wherein the recirculating furnace gases contact the heat exchange tubes and are cooled by the heat exchange tubes before the recirculating furnace gases are mixed with combustion air.

17. A low $NO_x$ burner according to claim 1 wherein the second fuel gas spud extends a third distance into the combustion chamber, the third distance being shorter than the second distance.

* * * * *